United States Patent [19]

Gentil

[11] 3,971,172

[45] July 27, 1976

[54] PREFABRICATED CONSTRUCTION

[75] Inventor: Robert Gentil, Paris, France

[73] Assignee: Industrielle de Constructions Mobiles, Paris, France

[22] Filed: May 6, 1975

[21] Appl. No.: 574,965

[30] Foreign Application Priority Data

| | | |
|---|---|---|
| May 8, 1974 | France | 74.15948 |
| May 8, 1974 | France | 74.15949 |
| May 8, 1974 | France | 74.15950 |
| May 8, 1974 | France | 74.15951 |

[52] U.S. Cl. ..... 52/28; 52/79; 52/236; 52/219

[51] Int. Cl.[2] ..... E04G 1/02

[58] Field of Search ..... 52/79, 234, 143, 734, 52/736, 219; 217/12 R, 13, 45, 43 R

[56] References Cited

UNITED STATES PATENTS

| | | | |
|---|---|---|---|
| 1,650,262 | 11/1927 | Carlton | 217/12 R |
| 1,995,573 | 3/1935 | Matthews | 52/79 |
| 3,095,616 | 7/1963 | Bigelow | 52/143 |
| 3,792,558 | 2/1974 | Berce | 52/143 |
| 3,824,750 | 7/1974 | Antoniou | 52/79 |

FOREIGN PATENTS OR APPLICATIONS

| | | | |
|---|---|---|---|
| 753,001 | 2/1967 | Canada | 52/79 |
| 1,371,438 | 7/1964 | France | 52/236 |
| 413,196 | 7/1934 | United Kingdom | 217/13 |

*Primary Examiner*—John E. Murtagh
*Attorney, Agent, or Firm*—Eric P. Schellin

[57] ABSTRACT

The prefabricated construction comprises a framework comprising a lower structure, an upper structure and vertical uprights interconnecting the structures. Each structure comprises a substantially rectangular frame which has at each corner a vertical corner member. The corner members are adapted to fit with the uprights and detachable means are provided for fixing and guiding the corner members and uprights.

The upper and lower structures may be placed directly together with the component parts of the construction enclosed between these assembled structures for transporting the construction.

26 Claims, 9 Drawing Figures

PREFABRICATED CONSTRUCTION

The present invention relates to light constructions which may be employed in particular as building site barracks, temporary offices, additional living quarters, and it more particularly relates to improvements in the framework of such a construction.

Light, fixed or movable, constructions are known which comprise a metal framework whose various elements are welded together, this framework being thereafter completed by lateral panels which are secured to the framework by any suitable means, such as Parker screws or the like. It will be understood that these constructions are completed by a floor and roofing.

As compared to the various known constructions, an object of the present invention is to provide a metal framework and a construction comprising such a framework which permit obtaining the following results:

particularly simple and rapid assembly and disassembly;

possibility of juxtaposition and superimposition of elementary cells without modification of the various elements while conserving excellent features of rigidity and strength;

particularly small overall size in the disassembled condition and particularly advantageous transporting conditions.

According to the invention, there is provided a metal framework of the type comprising a lower structure and an upper structure and vertical uprights, wherein the lower structure and upper structure each comprise a frame having a substantially rectangular shape and provided at each corner with a vertical member adapted to come in contact, respectively, with a lower part and upper part of a vertical upright, each of said members and each upright comprising complementary detachable fixing and centering means.

In one embodiment:

said corner members are constituted by L-shaped members having an edge facing inwardly of the framework and two flanges which are adpated to come in contact with adjacent surfaces of the uprights which are of square or like cross-section;

the upper structure comprises two section members fixed together, namely an upper section member constituting a channel or gutter and supporting the roofing and a lower section member which is open on its side facing inwardly of the framework or of the construction and in which can be received water supply pipes, electric cables etc. and lighting means, this lower section member being subsequently closed by plates some of which are translucid.

Another object of the invention is to provide a construction comprising a framework such as that defined hereinbefore, wherein the upper structure comprises a substantially horizontal ledge extending inwardly of the construction and under which there is engaged, parallel to the plane of the roofing, a section member for blocking roof elements; there being provided between two parallel section members of the upper structure detachable cross-members comprising in the vicinity of their ends abutment means for the roof elements so as to define a gap between the roof elements and the adjacent vertical wall.

According to another essential feature: in the disassembled position, the two lower and upper structures, respectively carrying the floor and roofing, bear against each other and are assembled, preferably at the corners, by suitable means, the other component elements of the construction being disposed in the volume thus defined. The assembly thus formed constitutes its own packing and may be transported over land or by air or sea without requiring an additional packing, which constitutes a substantial economy.

The invention will now be described in a more precise and detailed manner in the ensuing description with reference to the accompanying drawings which are given solely by way of example and in which.

Figure 1:
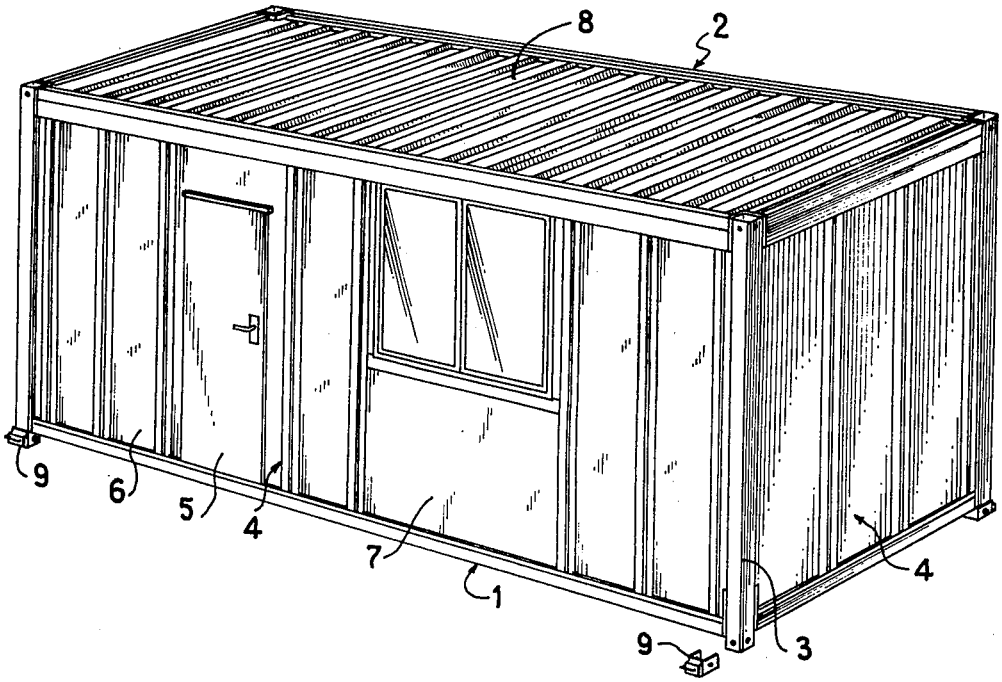
FIG. 1 is a perspective view of a construction according to the invention.

FIG. 1 shows a light construction which may be employed, for example, as a building site barracks, temporary office, or additional living quarters either in the unit form as shown or in the form of a plurality of elementary cells in juxtaposed or even superimposed relation. As can be seen in the drawings, this construction comprises mainly: a lower structure 1, an upper structure 2, corner uprights or posts 3 which constitute the metal framework of the building, this framework being provided with lateral walls 4 which are formed, in the presently-described embodiment, by panels which have a width equal, or proportional, to a given module. Thus, for example, the door panel 5 has a width equal to that of two single panels 6, and a window panel 7 has a width equal to that of three single panels. The floor (not shown) bears on the lower structure and the roofing 8 on the upper structure.

FIG. 1 also shows shoes 9 which may be fixed to the lower part of each upright to facilitate the displacement of the assembled construction and the sliding thereof over the ground. The shoes may of course have any required orientation.

Figure 2:
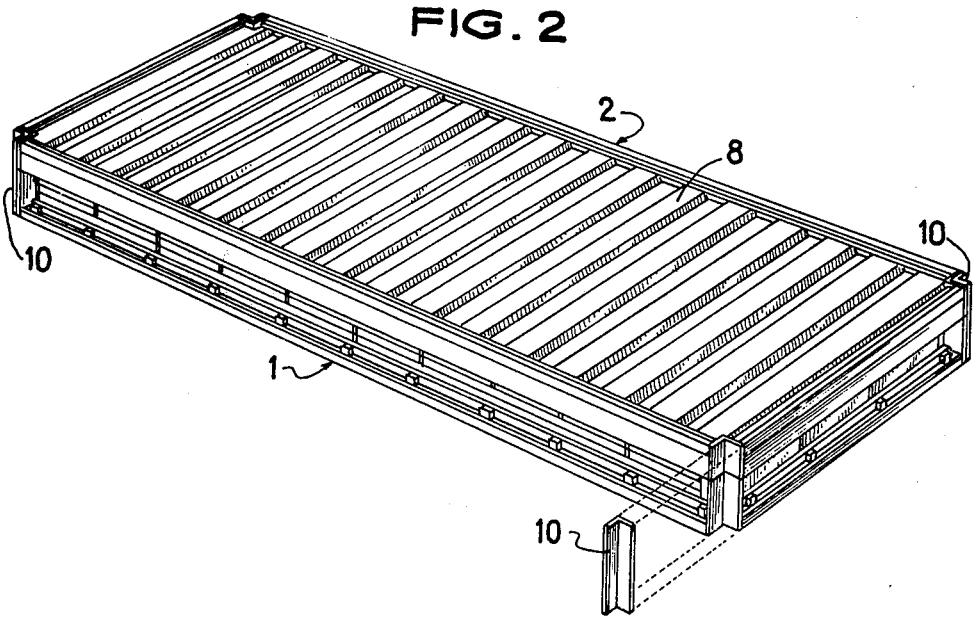
FIG. 2 is also a perspective view of the component elements of the construction shown in FIG. 1 in their transporting configuration.

Before describing in detail the framework and the consstruction according to the invention, it will be mentioned that, as shown in FIG. 2, the upper and lower structures bear against each other and are assembled, in the presently-described embodiment, by corner members 10 the height of which is equal to the sum of the heights of the lower and upper structures, or exceeds these heights if it is desired to increase the free height and volume between the floor and the roofing. The assembly may be achieved of course by any suitable means, such as bolts and in regions other than the corners. In FIG. 2, the floor and the roofing are in position, respectively on the lower and upper structure, the panels and, as the case may be, the other accessories of the bungalow being disposed and suitably blocked in position in the volume which is thus defined. Of course, if necessary, it is possible to provide lateral strips which close the rectangular-sided assembly and improve this packing, which is however already particularly effective. In the transporting position, the rectangular-sided assembly may be disposed on its edge, for example, in a road or rail vehicle, or flat on its side if its size corresponds to regulation standards.

Figure 3:
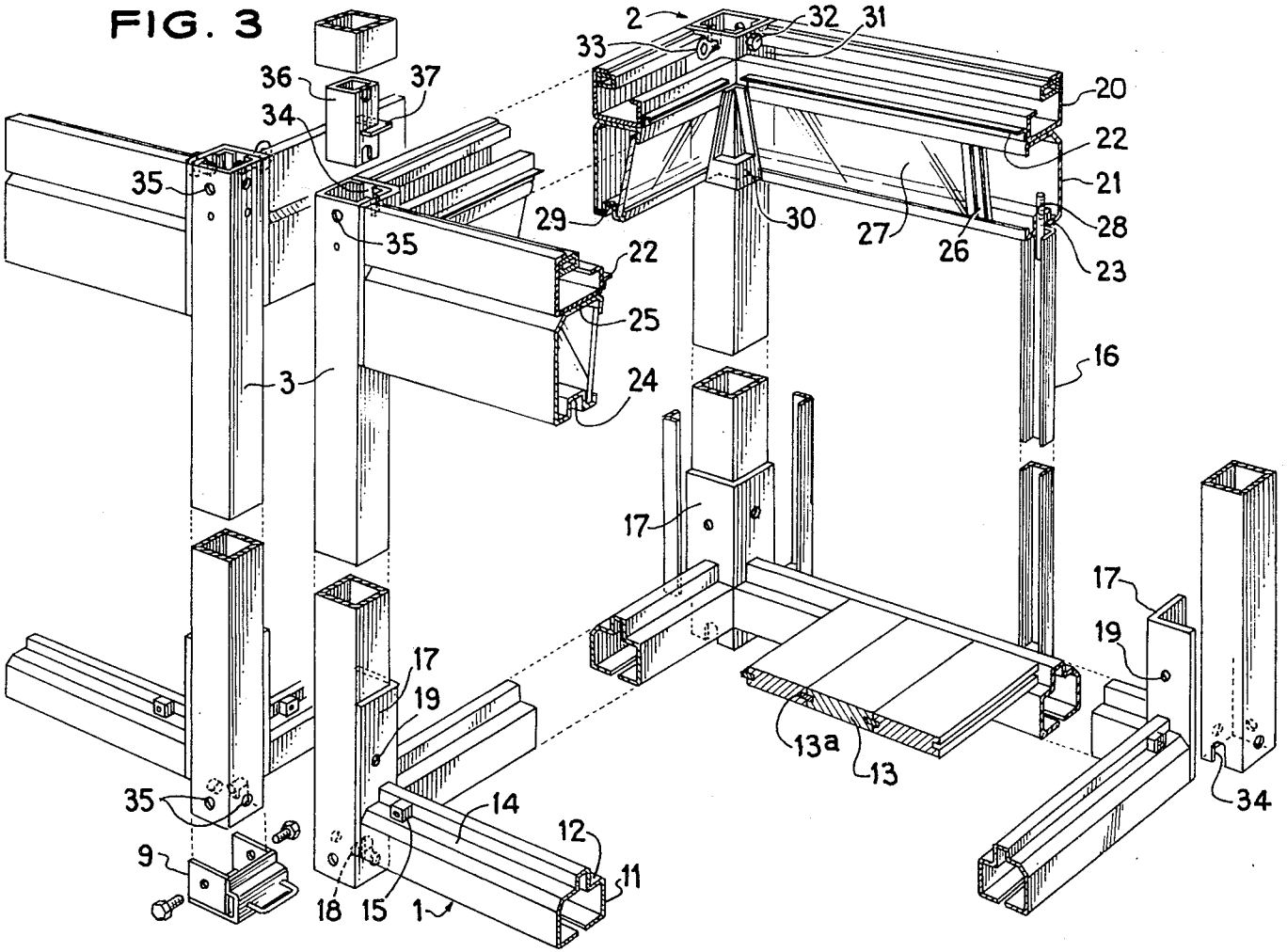
FIG. 3 is an exploded perspective view of the main features of the framework according to the invention.

With reference now to FIG. 3, which represents in more detail the metal framework of the construction of the invention, this framework comprises mainly the lower structure 1, the upper structure 2 and the corner uprights or posts 3.

The rectangular lower structure or frame 1 comprises box-shaped section members 11 mainly defining a support surface 12 for the floor elements 13 and a support surface 14 for the panels constituting the lateral walls. This section member also carries, on an outwardly facing surface, members 15 on which intermediate uprights 16 are engaged. At the four corners of this lower frame there are disposed L-section members 17 each carrying a suitable number of welded screwthreaded rods 18 adapted to permit the fixing of the uprights 3. These L-section members may moreover include a number of orifices 19, which may be screwthreaded or unscrewthreaded, for the passage of assembling or fixing elements such as bolts or the like.

The floor 13 is merely placed on the lower frame and juxtaposed elements are assembled by false tongues **13*a***, which gives this floor a certain flexibility and in particular enables it to rise without breaking and without damage if it comes in contact with a projecting part of the ground.

The upper structure or frame 2 is also rectangular in shape and mainly comprises two section members welded together, namely an upper section member 20 and a lower section member 21. The upper section member has a generally U-shaped section whose opening faces upwardly and whose two flanges have unequal lengths in cross section, this section member acting as a channel or gutter and also providing a support for ceiling elements (not shown in FIG. 3) which bear against a L-section member 22 welded to the inner surface of the section member 20 and a layer of insulating material and the roofing proper 8, which may be mounted and fixed in position in the manner described hereinafter with reference to FIGS. 4 to 6.

The lower section member 21 also has a generally U-shaped section the opening of which faces inwardly of the construction, the lower flange 23 thereof defining a recess 24 for receiving the lateral panels. In the presently-described embodiment, this lower flange also has a length less than that of the upper flange 25 in cross section. Moreover, section members 26 having a suitable section, for example a Ω-section, are disposed at regualr intervals between the two opposed flanges of this section member 21 so as to stiffen it and allow the mounting of translucid or opaque plates as shown at 27 in FIG. 3. Provided in the lower side of the section member 21 are orifices 28 for the mounting and fixing of intermediate uprights 16 and orifices 29 located at regular intervals, substantially in the region of the median part of the filling panels, and adapted to permit the descent in these panels of water drain pipes or electric supply cables. Such pipes, which pass through the box structure formed by the section member 21 have not been shown in the drawing. This section member may contain lighting systems providing a particularly pleasant and effective lighting. Attached in the corners are fittings 30 of pyramidal shape defining a passage for the aforementioned pipes or cables from one section member 21 to the adjacent section member disposed at right angles thereto.

Provided in each corner of the upper frame are L-section members 31 carrying, in the same way as the lower L-section members, screwthreaded rods 32 for the mounting and fixing of the uprights. In each corner one of the screwthreaded rods also forms a hoisting ring 33.

The uprights 3 which are disposed at the four corners of the framework are of a substantially square cross-sectional shaped in the presently-described embodiment and comprise at their ends notches 34 which receive screwthreaded rods fixed to the L-section members. These uprights also include orifices 35, which may be screwthreaded or unscrewthreaded, or welded nuts disposed at suitable positions, for fixing or assembling frameworks pertaining to adjacent cells.

FIG. 3 also shows the manner in which the framework pertaining to adjacent cells may be assembled, this assembly being achieved in a very simple manner by placing the two frameworks together in pairs along two of their sides and connecting them together by means of screwthreaded rods and nuts extending through two adjacent uprights. This assembly is carried out of course at the lower part and upper part and sealing elements are provided between two adjacent frameworks.

It is also possible to construct with the framework just described, which is particularly rigid and strong in particular owing to the shape of the section members employed, buildings having a plurality of floors, it being possible to assemble two superimposed frameworks by means of intermediate members such as that shown at 36 in FIG. 3 which comprises a section of a cube provided with a flat plate 37 and is engaged in the superimposed lower and upper uprights. This plate may of course also comprise notches and orifices for the passage of screwthreaded rods and nuts which extend inside each upright.

However, the shape of these connecting parts is not limited to that illustrated and it is for example possible to employ simple L-section members. Further, although the lower and upper frames have at each corner an L-section member they could also have tubes of similar section slightly greater than that of the upright in which the lower and upper parts of the uprights are fitted. Such an arrangement would require higher precision in manufacture but would provide improved strength.

It can be seen that the assembly of such a construction is particularly simple and easy since, with the lower frame placed in a flat position, it is sufficient to place in position the corner uprights by engaging the notches of these uprights on the screwthreaded rods provided on the L-section members. A pre-assembly can thus be immediately achieved. Similarly, in the upper part, the upper structure may be placed in position and easily fixed to the uprights by means of the same screwthreaded rods and nuts. The final fixing can be achieved and completed by bolts and nuts.

All the water and electricity supply elements are provided in the lower section member of the upper structure. The various panels constituting the lateral walls are placed in position at will by the user, some of these panels may comprise a door, a window, electric power supply sockets, an outlet for a chimney pipe etc.

These various features permit a particularly easy composition in an elementary cell and by the juxtaposition of a plurality of cells. The panels between the adjacent cells may or may not be filled or partially fitted. If it is desired to place such panels in position, the construction is nonetheless sufficiently strong owing to the nature of the section members constituting the upper frame. As mentioned hereinbefore, the various cells may also be superimposed in a particularly easy manner, since none of the component elements of these cells needs be modified. In this case, in order to reinforce the construction, concrete may be poured into the vertical uprights and this gives a particularly strong framework.

Transport is moreover greatly facilitated since, when it has the configuration shown in FIG. 2, the construction has an overall size which is reduced to that of the assembly constituted by the superimposition of the lower and upper structures, the other elements of the cells being disposed within the volume thus defined. No additional packing is consequently necessary and this constitutes an appreciable economy. For transport, the assembly may be placed on edge so that it is possible, by suitably choosing the dimensions, to transport a plurality of cells on the same vehicle, for example a road vehicle, within a very small volume.

Figure 4:
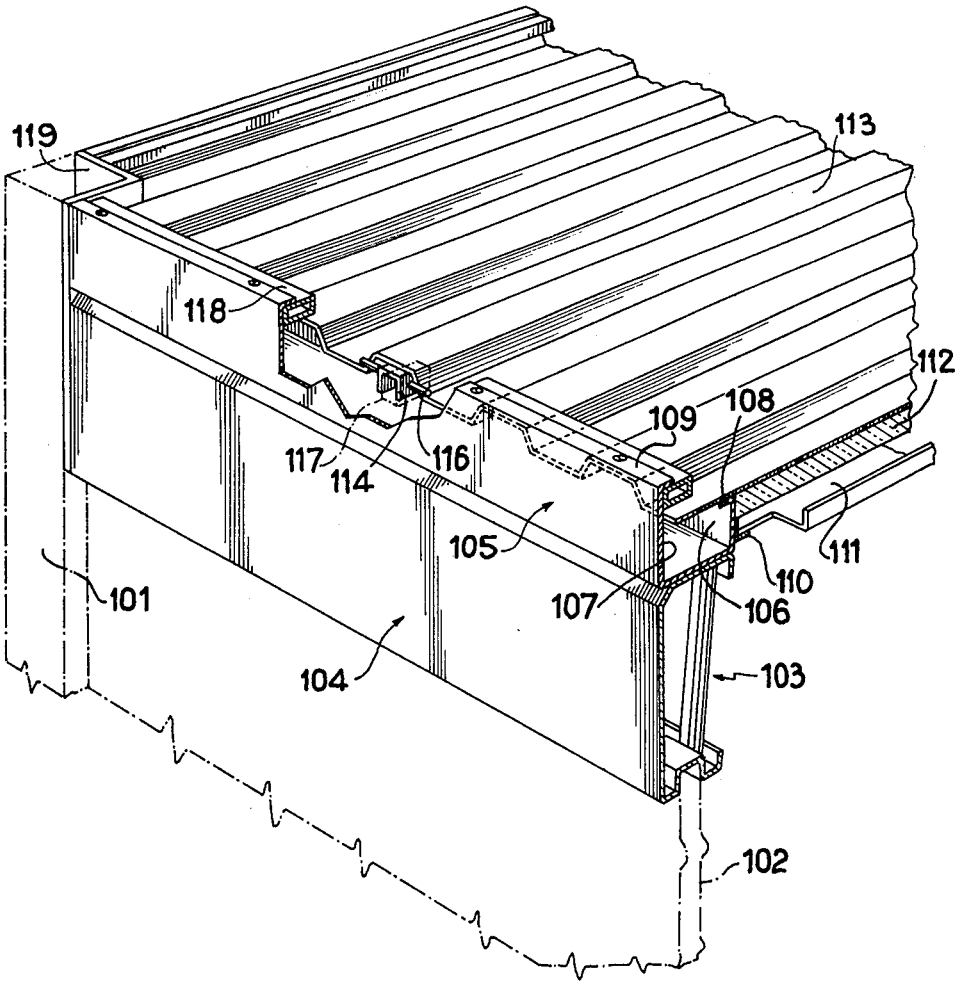
FIG. 4 is a partial perspective view, with parts cut away, of the roofing of a construction according to the invention.

FIG. 4 shows a portion of the upper part of a light construction or bungalow according to the invention whose vertical uprights 101 and lateral walls 102 have been shown in dot-dash line. This construction comprises a metal framework and in particular an upper structure 103 constituted, in the presently-described embodiment, by two welded section members, namely a lower section member 104 and an upper section member 105 which has a generally U-shaped cross section and two flanges 106, 107 of unequal lengths in cross section, the shorter flange 106 being located adjacent the inside of the bungalow, whereas the longer flange 107 is located on the outside. The two flanges of the U-section terminate at their free ends in two horizontal ledges 108, 109 which extend toward each other.

Moreover, on its inner vertical face, the upper section member carries a welded L-section member 110 on which ceiling elements 111 are disposed. This L-section member could be eliminated and its function performed by an extension of the upper flange of the section member 104. Above the ceiling elements there is provided an insulating element 112 constructed from any suitable material whereas the roofing is here constituted by corrugated metal sheets 113 or sheets of synthetic material bearing on the horizontal ledge 108 of the inner flange of the section member 105. The length of the elements 113 is less than the distance between the outer flanges of two parallel section members 105 corresponding to the opposed panels of the construction.

Figure 6:
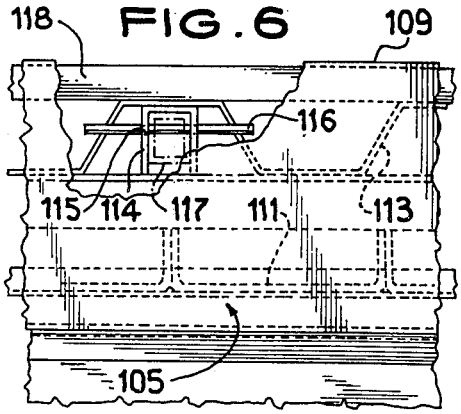
FIG. 6 is a side elevational view, with parts cut away, of the exterior of the construction.

Cross-members 114 are provided which have a U-shaped cross section and also bear on the horizontal ledge 108 of the inner flange of the section member 105, these cross-members having a length slightly less than the horizontal distance between the two outer flanges of the two section members 105 corresponding to the two opposed panels of the construction and including in the vicinity of each end two orifices 115 in which there may be engaged a pin 116 having a length exceeding the width of the cross-member 114 (FIG. 6).

Members 117 may also be welded to the inner surface of the outer flange of the U-section member 105, these members being adapted to receive the cross-members 114 and also including, if desired, orifices for the passage of the aforementioned pins to laterally position the cross-members.

The roofing elements are held in position and locked by means of a flat strip or a tubular section member 118 which is engaged between the edge of the roofing elements and the horizontal ledge 109 of the outer flange of the section member 105. This member 118 is of very simple shape, for example rectangular, and engaged roughly horizontally under the ledge 109 parallel to the roofing and therefore ensures an effective wedging of the roofing elements even in the case of wind which would tend to raise the roofing. Screws may be provided for interconnecting the member 118 and the ledge 109. Note that these screws do not extend through the roofing and do not form a leak path.

Figure 5:
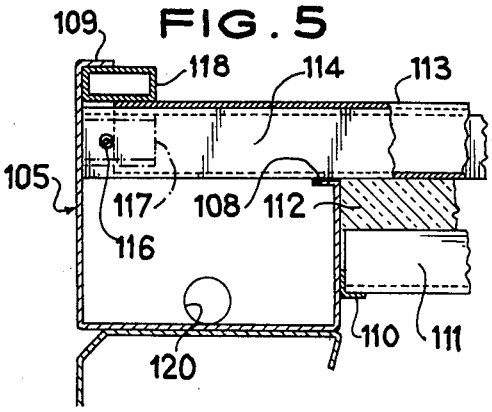
FIG. 5 is a sectional view in the vicinity of a longitudinal element of the upper structure.

In the corner of the building, an L-section member 119 is disposed between the longitudinal element and transverse element of the upper structure, this L-section member having an orifice 120 shown in FIG. 5 for communication with the vertical upright 101, shown in dot-dash line, which comprises an orifice disposed in alignment with the orifice 120. In this way the U-section members can act as a gutter and the vertical uprights as rain water descent pipes.

It will be understood from the foregoing description that the roofing can be placed in position very simply, since all its elements are capable of being disassembled and the only fixing and retaining means are constituted by pins 115 disposed at the ends of the cross-members and by the tubular section members 118 which maintain the roofing elements in position with respect to the framework of the building. This positioning comprises in succession: mounting the ceiling, the insulating element, the cross-members 114, the roofing elements 115, and then the pins 116 and section members 118.

The pins ensure the abutment of the roofing elements and prevent the latter from coming in contact with the outer flange of the U-section member 105, which would hinder the flow of rain water toward the bottom of the section member which acts as a gutter as mentioned hereinbefore. Note that no fixing means extend through the roofing elements which have absolutely no orifice and consequently ensure an optimum sealing. Finally, the disassembly is just as easy, since it is sufficient to disengage the locking section members, and then the pins, if they are provided, to be in a position to disengage the roofing elements and the cross-members disposed thereunder.

By way of a modification, it is possible to provide in the sheets 113 of the roofing notches or orifices through which the pins 116 may pass, these pins thus ensuring both the horizontal abutment and the vertical retention of the sheets 113.

Figure 7:
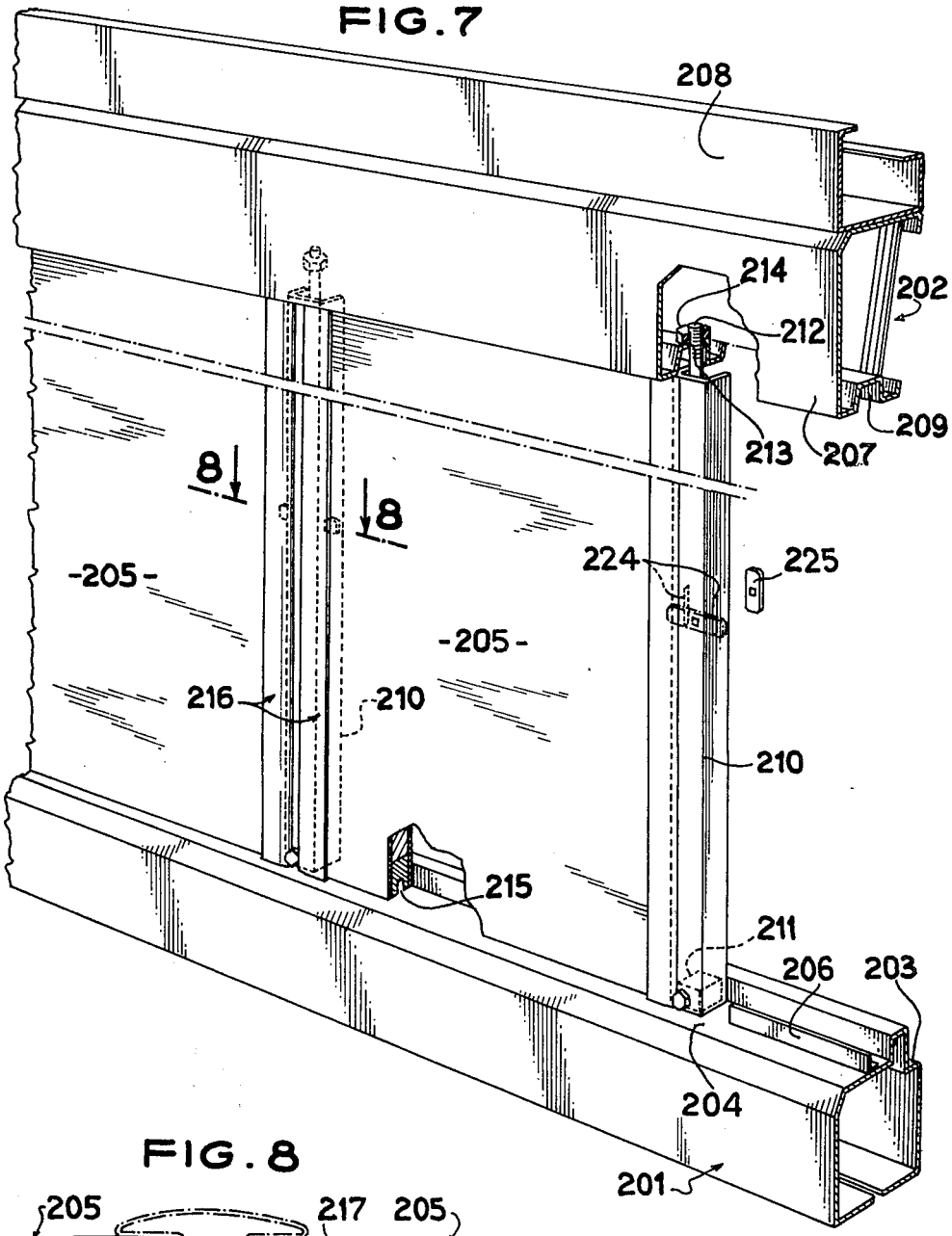
FIG. 7 is a perspective view, with parts cut away, of a part of a lateral wall of the construction according to the invention.

A part of a light construction whose metal framework comprises a lower structure 201 and an upper structure 202 is shown in FIG. 7. The lower structure mainly comprises a section member defining a bearing surface 203 for the floor (not shown) and a bearing surface 204 for panels 205 constituting lateral walls. Provided on this horizontal surface 204 is a welded L-section member 206 for laterally maintaining and guiding these panels. The upper structure is mainly constituted by two welded section members 207, 208. The lower section member 207 defines in its lower surface a recess 209 in which the lateral panels may also be engaged.

Intermediate uprights or posts 210 are disposed at regular intervals between the lower structure and upper structure. These uprights are constituted by U-section members in the presently-described embodiment. Each upright is engaged in its lower part on a square-shaped member 211, welded to the lower structure and to which it may be fixed, whereas in its upper part it carries a screwthreaded rod 212 which is engaged in an orifice 213 in the upper structure and may receive a fixing nut 214.

Figure 8:
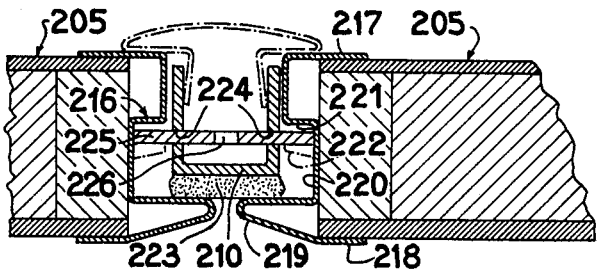
FIG. 8 is a sectional view, taken on line 8—8 of FIG. 7 to an enlarged scale, of a detail of the device for mounting two panels.

Reference will now be made to FIG. 8 for describing in more detail the panels and the manner in which they are mounted and locked. Each panel constructed in any suitable way, for example in the form of a sandwich or other panel, comprises in its lower surface a groove 215 which is engaged on the vertical flange of the L-section member provided on the lower structure. Moreover, each panel carries on its vertical edge a section member 216, for example made from a suitable plastics material and elastically clipped onto this panel. This section member has two end flanges 217 and 218 which are in contact with the lateral surfaces of the panel and, between these two end flanges, it defines a branch 219 which has for example a triangular cross-sectional shape and whose function is to seal, a surface 220 for bearing against the edge of the panel and at least one abutment surface 221 which may be completed by a second abutment 222.

It is clear from FIG. 8 that the U-section member 210 carries at its outer surface a sealing element 223 also of any suitable type.

This U-section member also includes, for example half way up its height, two slots 224 formed in its lateral flanges and disposed in front of each other, these two slots being located slightly outside the abutment surface 221 of the section member 215 associated with the adjacent panel. These two slots are adapted to receive a member 225 constituting a key and constituted by an elongated metal plate which, when in a vertical position, can engage between the flanges of the U-section member 210 and which, when rotated through 90° by means of a square tool disposed in an opening 226 of complementary shape, can occupy the position shown in dotted line in FIG. 7 and in full line in FIG. 8.

FIG. 8 also shows in dot-dash line a strip 227 adapted to close off the opening of the U-section member on the inner side of the construction, this strip having a suitable profile and being elastically clipped between the flanges of the U-section member 210.

It will be understood from the foregoing construction that the panels are very easily assembled by first engaging these panels in the recess 209 provided in the upper structure then lowering these panels onto the vertical flanges of the L-section members 206. The panel is then brought against the adjacent intermediate upright so as to take up the position shown in FIG. 8 after which the, or each, locking key 225 is placed in position as described hereinbefore. Of course, it is possible, if desired, to provide a plurality of keys spaced vertically apart on the upright but in most cases this is unnecessary.

It is clear that the invention permits a particularly rapid assembly and disassembly of the panels and that, notwithstanding this simplicity and rapidity of assembly, there is obtained an excellent rigidity owing to in particular the presence of the intermediate U-section uprights, which may also be disassembled, and also owing to the locking means which ensure an effective interconnection between each panel and its intermediate uprights.

Moreover, a very satisfactory seal is obtained by contact of the plastics section members with the sealing element 223 carried by the intermediate uprights. These section members allow a wide tolerance of several millimetres in the thickness of the panels.

Figure 9:
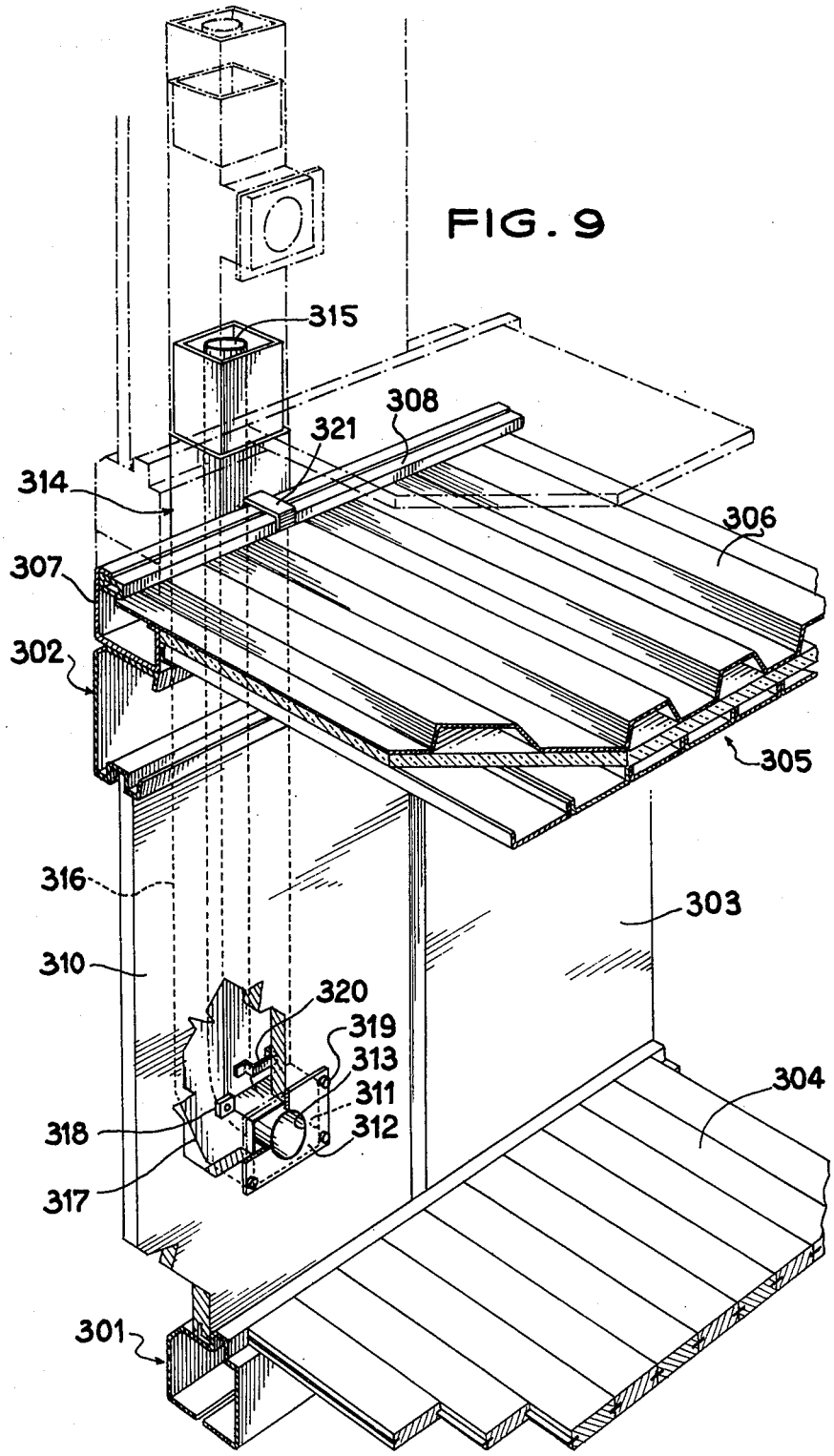
FIG. 9 is a perspective view, with parts cut away, of a smoke pipe with which such a construction is equipped.

FIG. 9 shows a part of a light construction comprising a metal framework mainly comprising a lower structure 301 and an upper structure 302 which are interconnected by vertical uprights (not shown) and between which there are disposed panels 303 constituting the lateral walls.

The construction is completed by a floor 304 of any suitable type and roofing 305 such as described hereinbefore and comprising elements 306 of corrugated sheet fixed to a section member 307, which is part of the upper structure, by means of a tube 308 of rectangular section engaged between the roofing elements and the section member 307.

The smoke flue or pipe device comprises a panel 310 which may be a sandwich panel or some other panel and in which there is provided an opening 311 of for example rectangular shape, covered with a metal plate 312 in which is formed a circular orifice 313 adapted to receive the smoke pipe extending from the heating apparatus (not shown).

The device is completed by an element 314 located outside the construction and comprising mainly a metal pipe 315 provided with a sheath or liner 316. The liner and pipe terminate in their lower part in an elbow 317, the liner comprising on its end face means 318 complementary to those provided on the plate 312 associated with the panel to permit the assembly, for example by means of screws 319, of the two main elements of the device, namely the panel 310 and the outer element 314. This outer element further comprises an abutment 320 which comes in contact with the outer surface of the panel.

In its upper part and on its surface facing the panel, the sheath 316 carries a hook-shaped member 321 whose dimensions are such that it can hook, in the presently-described embodiment, onto the section member 308 maintaining the roofing elements. This member 321 constitutes the upper fixing means for the smoke pipe.

It is clear from the foregoing description that the smoke pipe device is particularly easy to employ bearing in mind that it is constituted by pre-fabricated elements which may be placed in position in any suitable chosen place of the construction with no need to provide openings in a lateral wall or in the roofing, the hooking and the mounting of the outer element being rendered particularly easy by the presence of complementary means 312, 318 on this element and on the associated panel and by the presence of hooking means 321 in the region of the roofing. Disassembly is of course just as easy.

Having now described my invention what I claim as new and desire to secure by Letters Patent is:

1. A metal framework for a prefabricated construction, comprising a lower structure and an upper structure and vertical uprights, the lower structure and upper structure each comprising a frame having a substantially rectangular shape, a vertical corner member provided at each corner of the frame, the vertical corner members of the upper structure being engaged with upper parts of the uprights and the vertical members of the lower structure being engaged with lower parts of the uprights, each of said vertical members and the corresponding upright comprising complementary detachable means for fixing and guiding the vertical member and uprights, wherein the fixing and guide means comprise screwthreaded rods carried by the corner members and notches provided respectively at lower and upper ends of the uprights, and nuts screwed tight on the screwthreaded rods so as to achieve the fixing.

2. A metal framework as claimed in claim 1, wherein the uprights have a square shape in cross-section and said corner members are constituted by L-section members each defining a corner edge facing inwardly of the framework and two flanges which are in contact with the adjacent surfaces of the corresponding upright.

3. A metal framework as claimed in claim 1, wherein the corner members and uprights comprise orifices for fixing them and for the assembly between two adjacent frameworks.

4. A metal framework as claimed in claim 1, wherein the corner members and uprights comprise means constituting nuts for fixing them and for the assembly between two adjacent frameworks.

5. A metal framework as claimed in claim 1, wherein the upper structure comprises two juxtaposed section members fixed together on each side of the frame, namely an upper section member constituting a channel for supporting a ceiling and roofing and a lower section member which is open on a side thereof facing the interior of the construction for receiving water supply pipes, electric supply cables, etc.

6. A metal framework as claimed in claim 5, wherein two adjacent lower section members of the frame are interconnected at each corner by a member defining a passage for the pipes, cables or other means.

7. A prefabricated construction comprising in combination: a framework comprising a lower structure and an upper structure and vertical uprights, the lower structure and upper structure each comprising a frame having a substantially rectangular shape, a vertical corner member provided at each corner of the frame, the vertical corner members of the upper structure being engaged with upper parts of the uprights and the vertical members of the lower structure being engaged with lower parts of the uprights, each of said vertical members and the corresponding upright comprising complementary detachable means for fixing and guiding the vertical member and uprights; a floor carried by the lower structure; a metal roofing carried by the upper structure; and lateral walls, the construction being such that, in a disassembled position thereof, the lower structure and upper structure lies one over the other and angle members cooperating with the vertical corner members assemble the upper structure and lower structure so as to constitute a packing, the uprights and lateral walls of the construction being disposed within the space defined by the upper and lower structures, wherein the height of the angle members is greater than the sum of the heights of the upper structure and lower structure so as to provide an increased height and volume between the floor and the roofing, lateral strips being mounted between the two structures to complete the packing.

8. A metal framework as claimed in claim 7, wherein the fixing and guide means comprise screwthreaded rods carried by the corner members and notches provided respectively at lower and upper ends of the uprights, and nuts screwed tight on the screwthreaded rods so as to achieve to fixing, said angles mebers comprising notches cooperating with said screwthreaded rods for assembling said upper structure and said lower structure in said disassembled position.

9. A prefabricated construction comprising in combination: a framework comprising a lower structure and an upper structure and vertical uprights, the lower structure and upper structure each comprising a frame having a substantially rectangular shape, a vertical corner member provided at each corner of the frame, the vertical corner members of the upper structure being engaged with upper parts of the uprights and the vertical members of the lower structure being engaged with lower parts of the uprights, each of said vertical members and the corresponding upright comprising complementary detachable means for fixing and guiding the vertical member and uprights; a floor carried by the lower structure; a metal roofing carried by the upper structure; and lateral walls, the upper structure comprising at least two parallel section members having a generally U-shaped section, namely an upper section member and a lower section member, the upper section member having an opening facing upwardly and two flanges of different height, the shorter flange being located adjacent the interior of the construction whereas the longer flange comprises a ledge which extends toward the interior of the construction, means for locking the roofing elements cooperating with said ledge, detachabe cross-members interposed between the two section members and comprising at one of their ends abutment means for the roofing elements whereby the roofing elements and the adjacent flange of the section member define a gap, said locking means being engaged substantially parallel to the plane of the roofing under said ledge of the outer flange of the section member.

10. A construction as claimed in claim 9, wherein each lower section member of the upper structure carries plates at least some of which are translucid, the lower section member containing lighting elements located in the region of the translucid plates.

11. A construction as claimed in claim 9, wherein the abutment means for the roofing elements are constituted by orifices provided in the cross-members and pins which are engaged in the orifices.

12. A construction as claimed in claim 11, wherein each section member carries a member on which the cross-members are fixed.

13. A construction as claimed in claim 9, wherein the cross-members have an inverted U-shaped cross section.

14. A construction as claimed in claim 9, wherein the locking means has a substantially rectangular section.

15. A metal framework for a prefabricated construction, comprising a lower structure and an upper structure and vertical uprights, the lower structure and upper structure each comprising a frame having a substantially rectangular shape, a vertical corner member provided at each corner of the frame, the vertical corner members of the upper structure being engaged with upper parts of the uprights and the vertical members of the lower structure being engaged with lower parts of the uprights, each of said vertical members and the corresponding upright comprising complementary detachable means for fixing and guiding the vertical member and uprights, wherein the upper structure comprises two juxtaposed section members fixed together on each side of the frame, namely an upper section member constituting a channel for supporting a ceiling and roofing and a lower section member which is open on a side thereof facing the interior of the construction for receiving water supply pipes, electric supply cables, etc.

16. A metal framework as claimed in claim 15, wherein two adjacent lower section members of the frame are interconnected at each corner by a member defining a passage for the pipes, cables or other means.

17. A prefabricated construction comprising in combination: a framework comprising a lower structure and an upper structure and vertical uprights, the lower structure and upper structure each comprising a frame having a substantially rectangular shape, a vertical corner member provided at each corner of the frame, the vertical corner members of the upper structure being engaged with the upper parts of the uprights and the vertical members of the lower structure being engaged with lower parts of the uprights, each of said vertical members and the corresponding upright comprising complementary detachable means for fixing and guiding the vertical member and uprights; a floor carried by the lower structure; a metal roofing carried by the upper structure; and lateral walls, wherein the upper structure comprises two juxtaposed section members fixed together on each side of the frame, namely an upper section member constituting a channel for supporting the roofing and a lower section member which is open on a side thereof facing the interior of the construction for receiving water supply pipes, electric supply cables, etc.

18. A construction as claimed in claim 17, wherein the two juxtaposed section members have a generally U-shaped cross-section, the upper section member having an opening facing upwardly and two flanges of different heights, the shorter flange being located adjacent the interior of the construction whereas the longer flange comprises a ledge which extends toward the interior of the construction, said construction further comprising means for locking the roofing elements cooperating with said ledge, detachable cross-members interposed between the two section members and comprising at one of their ends abutment means for the roofing elements whereby the roofing elements and the adjacent flange of the section member define a gap, and wherein said locking means is an elongated member having an upper face and a lower face, said elongated member being engaged substantially parallel to the plane of the roofing with its upper face bearing against the under face of said ledge of the outer flange of the upper section member and its lower face resting on the edge of the roofing element.

19. A construction as claimed in claim 18, wherein the abutment means for the roofing elements are constituted by orifices provided in the cross-members and pins which are engaged in the orifices.

20. A construction as claimed in claim 19, wherein each section member carries a member on which the cross-members are fixed.

21. A construction as claimed in claim 18, wherein the cross-members have an inverted U-shaped cross-section.

22. A construction as claimed in claim 18, wherein said elongated member has a substantially rectangular section.

23. A construction as claimed in claim 17, comprising a panel defining a connecting orifice, a smoke pipe device and a liner which are fixed to the panel, the smoke pipe communicating with the connecting orifice, an outer element of the smoke pipe device carrying at least one member in the form of a hook which engages on an element of the framework of the construction.

24. A construction as claimed in claim 17, wherein the lower section member has at regular intervals orifices allowing the passage of pipes, cables, etc.

25. A construction as claimed in claim 17, wherein the intermediate uprights have a U-shaped cross section the opening of which section faces inwardly of the construction, the construction further comprising a sealing element carried by an outer surface of the web of each U-section intermediate upright, section members carried by panels adjacent the intermediate uprights, parts of said section members carried by the the adjacent panels cooperating with the corresponding sealing element, locking means comprising two facing slots provided in flanges of each U-section intermediate upright, a metal member constituting a key engaged in the slots and extending outwardly of the U-section intermediate upright, cavities defined by the section members carried by the adjacent panels and comprising at least one abutment surface, the key engaging said cavities and cooperating with said one abutment surface.

26. A construction as claimed in claim 25, wherein the key is a metal plate of oblong shape whose width is less than the width of the U-section intermediate upright and whose length is substantially greater than the width of the U-section intermediate upright, said plate having means for shifting the plate.

* * * * *